US005292119A

United States Patent [19]

Norcross

[11] Patent Number: 5,292,119

[45] Date of Patent: Mar. 8, 1994

[54] PNEUMATICALLY OPERATED BALL RELEASE BALL DELIVERY APPARATUS

[76] Inventor: Charles E. Norcross, 1448 Mediterranean Rd., Lake Clarke Shores, Fla. 33406

[21] Appl. No.: 36,311

[22] Filed: Mar. 24, 1993

Related U.S. Application Data

[63] Continuation-in-part of Ser. No. 877,901, May 1, 1992, abandoned.

[51] Int. Cl.[5] ..... A63B 69/40

[52] U.S. Cl. ..... 273/26 D; 273/29 A; 124/49

[58] Field of Search ..... 273/26 R, 26 D, 201, 273/129 R, 129 Q, 119 R, 119 A, 129 AP, 351, 315; 124/41 R, 47, 45, 49, 50, 51 R, 52, 53, 82, 56, 57, 53, 55, 83, 82, 84

[56] References Cited

U.S. PATENT DOCUMENTS

| | | | |
|---|---|---|---|
| 2,696,985 | 12/1954 | Hogeberg | 273/201 |
| 2,955,823 | 10/1960 | Chanko . | |
| 3,080,859 | 3/1963 | Benkoe . | |
| 3,368,541 | 2/1968 | Brink . | |
| 3,394,691 | 7/1968 | Brink . | |
| 3,467,073 | 9/1969 | Rhodes | 273/26 D |
| 3,612,027 | 12/1971 | Makino . | |
| 3,999,753 | 12/1976 | Desilets | 273/29 A |
| 4,004,567 | 1/1977 | Henderson | 124/50 |
| 4,132,214 | 1/1979 | Schurr | 273/29 A |
| 4,282,848 | 8/1981 | Kulesza et al. . | |
| 4,538,810 | 9/1985 | Brophy | 273/26 D |
| 4,676,504 | 6/1987 | Ponza | 273/26 D |
| 4,877,243 | 4/1988 | Taylor . | |
| 4,896,646 | 6/1988 | Kahelin . | |
| 4,955,606 | 9/1990 | Leps | 273/26 D |
| 5,042,802 | 8/1991 | DePianta | 273/26 D |
| 5,066,010 | 3/1991 | Pingston . | |
| 5,121,735 | 6/1992 | Hancock | 273/26 D |
| 5,133,330 | 7/1992 | Sharp | 273/26 D |

FOREIGN PATENT DOCUMENTS

| | | | |
|---|---|---|---|
| 551863 | 10/1958 | Italy | 124/53.5 |

*Primary Examiner*—Theatrice Brown
*Attorney, Agent, or Firm*—Quarles & Brady

[57] ABSTRACT

A ball delivering device for use in batting and racket swinging practice includes a stop and release assembly for reliably controlling the supply of an individual ball to a user's swing path while maintaining the remaining balls in a reservoir. The device is constructed to enhance safety and minimize risk or injury to unattended child users by incorporating an air pressure-actuated feeder for controlling the advancement of balls on an inclined, gravity-fed dispensing channel. The air-based feeder can be foot actuated so that the child may maintain a batter's stance while actuating the delivery of a ball to his swing path.

12 Claims, 5 Drawing Sheets

PNEUMATICALLY OPERATED BALL RELEASE BALL DELIVERY APPARATUS

CROSS REFERENCE TO RELATED APPLICATION

This application is a continuation-in-part of U.S. patent application Ser. No. 877,901, filed May 1, 1992, (Abandoned)

FIELD OF THE INVENTION

The invention relates generally to sports practicing aids and more particularly to devices for assisting in the practice of batting and racket swinging.

BACKGROUND OF THE INVENTION

Various devices have been developed to deliver balls to a practicing baseball batter or tennis player. Most known systems provide some means for tossing, pitching or launching a ball into the general swing path area typically encountered in actual game play.

Some devices, such as those shown in U.S. Pat. Nos. 3,080,859; 3,368,541; 3,394,691; and 3,612,027, are loaded with a single ball and have many associated disadvantages. Upon release by a foot actuator, the ball is hurled vertically into the user's swing path. This vertical launch is somewhat unnatural in comparison to the substantially horizontal flight of a normal pitch. These devices require loading, and sometimes recocking, before each "pitch" and swing, and it is sometimes difficult to maintain a correct batter's stance while activating these devices. These ground-based devices also rely on propelling mechanisms to hurl the ball upwardly, and such forces can present a danger to young children, practicing without adult supervision.

Other known ball delivering systems store multiple balls. U.S. Pat. Nos. 4,282,848; 4,676,504; 4,896,646; and 5,066,010 disclose mechanized multiple ball delivery systems. These mechanized systems are sometimes electrically driven, requiring access to an electric outlet. Others have multi-component mechanisms having interconnected gears, springs and detents to control the feed of the balls. Electrically powered systems can expose unattended children to the risk of electrocution, and complicated mechanisms can endanger unattended children who attempt to repair a mechanism broken during practice or play.

SUMMARY OF THE INVENTION

It is an object of the invention to provide a ball delivery device for batting practice and the like that minimizes the risk of an injury to unattended child users.

It is another object of the invention to provide a ball delivery device that is simple in construction to minimize the potential for breakdown during use.

It is a further object of the invention to provide a ball delivery device for batting practice that can be reliably actuated by a user after achieving a batting stance.

It is yet another object of the invention to provide a ball delivery device for batting practice that is capable of storing multiple balls yet ensures that a single ball is dispensed while restraining the remaining balls from advancement.

It is another object of the invention to provide a ball delivery deice that is simple in construction to minimize manufacturing cost;

These and other objects of the invention are achieved by a ball delivering device which includes a stop and release assembly for reliably controlling the supply of individual balls from a reservoir to a user's swing path while maintaining the remaining balls in storage. The device generally includes a reservoir or other structure for storing a plurality of balls; a downwardly inclined passage for transporting the balls from the storage structure to the user's swing path area along a discharge path defined by the passage; and structure, such as stands, for elevating the channel to provide a selectively adjustable discharge outlet.

According to one embodiment of the invention, the balls are restrained from advancing through the passage by a stop, such as a mound formed in the discharge path of the passage. A release is constructed to urge a first one of the balls past the stop for subsequent delivery to the user. The release is preferably formed by a wedge, movable in and out of the discharge path between the first and second balls to advance the first ball and then retract. The wedge can be actuated into the discharge path on the head of a piston that is reciprocally mounted in an air cylinder mounted to a side or the bottom of the discharge channel. The device can include a foot actuator having an air ballast for supplying the actuating air pressure to the air cylinder by depression with the user's foot.

In an alternative embodiment of the invention, the balls are restrained from advancing through the passage by a stop, such as a cross member inserted in the discharge path of the passage. A release is constructed to urge a first one of the balls over the cross member for subsequent delivery to the user According to the alternative embodiment, the release is preferably formed by an inflatable air bladder mounted beneath a flexible pad. The air bladder and flexible pad are attached to a lower surface of the downwardly inclined passage. The air bladder can be inflated to cause the flexible pad to lift a ball over the cross member. The device can include a foot actuator having an air ballast for supplying the actuating air pressure for the air bladder by depression with the users foot.

While electrical and mechanized systems can potentially injure users, dangerous risks of injury to unattended child users are minimized by the air pressure-based stop and release assembly in combination with the gravity fed inclined passage. While maintaining safety, this assembly also reliably advances a single ball to the batter's swing path while inhibiting the discharge of the remaining balls. Further, the system allows proper development of batting technique by allowing the user to maintain a batter's stance during dispensing actuation.

BRIEF DESCRIPTION OF THE DRAWINGS

A more detailed understanding of the invention can be gained by a thorough reading of the following detailed description in connection with the associated drawings, in which.

DETAILED DESCRIPTION OF THE PREFERRED EMBODIMENTS

Figure 1:
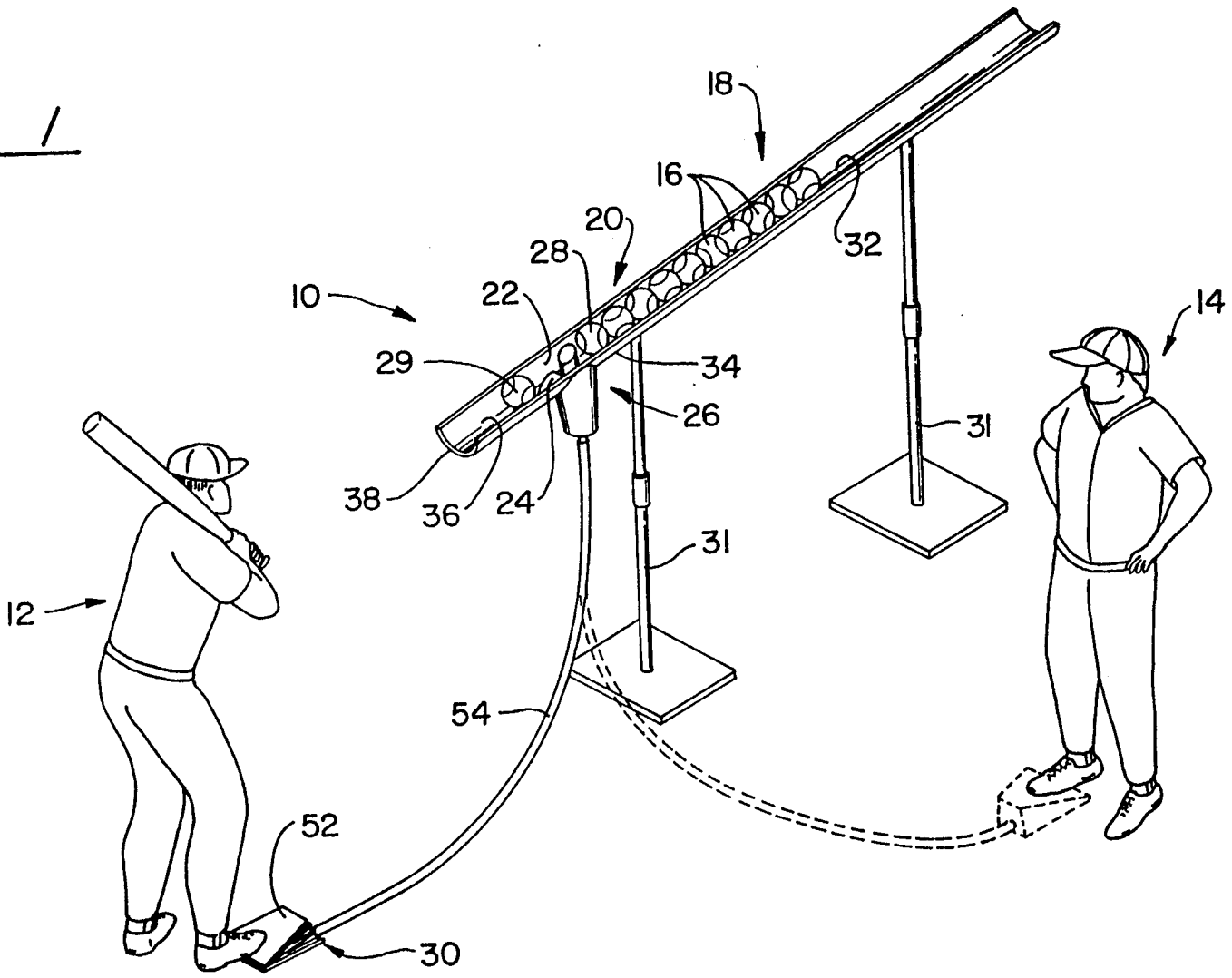
FIG. 1 is a perspective view of the ball delivering device.

Referring to FIG. 1, the invention is directed to a device 10 for safely and reliably advancing individual balls to a practicing user, such a batter 12, according to actuation by the batter 12 or an attending bystander 14. While the preferred embodiments of the invention are discussed in the context of batting practice, the device is equally applicable to racket swinging practice for tennis, racket ball, squash or the like, and the device 10 can be constructed to accommodate the different size balls required in the different sports.

Generally, the ball delivering device 10 includes structure, such as a reservoir 18, for storing a plurality of balls 16 and a downwardly inclined passage 20 extending from the reservoir 18 to transport balls 16 along a discharge path 22 to the swing path of the batter 12. The balls 16 are restrained from advancement through the passage 20 by a stop, such as a mound 24, and a release 26 is provided for urging the first ball 28 in line over the mound 24 for subsequent delivery to the batter 12. The release 26 preferably includes a control 30 which is selectively depressed by the batter 12 to advance individual balls from the passage 20. Elevating structure, such as stands 31, adjustably positions the passage 20 at selected heights.

The reservoir 18 is preferably formed as an elongated channel 32 to store the balls 16 is a substantially straight queue. The channel 32 is inclined downwardly to advance the balls 16 to the passage 20 safely and automatically under the influence of gravity. The reservoir 18 can also be constructed in a variety of other shapes and configurations that readily feed balls to an outlet for subsequent transport through the passage 20. The channel 32 can be provided with a series of progressively widening and elevating grooves to form centering tracks for balls of different sizes.

The passage 20 is preferably inclined downwardly to automatically transport balls from the reservoir 18 to the batter 12 under gravity and is preferably constructed as a channel 34 integrally with the reservoir channel 32. The passage 20 preferably includes a runway 36 extending at least twelve inches below the stop to allow trajectory development of a released ball 29 before ejectment from a discharge outlet 38 of the passage 20. The runway 36 can be constructed at a steeper angle and have a curved contour relative to the passage 20 to effect different trajectory developments. In a preferred embodiment, as shown, the runway 36 is shaped continuously with the reservoir 18 and passage 20 to facilitate manufacture, and the stands 31 are individually adjustable to control the angle of inclination of the passage 20 and runway 36, and thereby control the departure speed of the released ball 29.

The advancement control of individual balls centers around the stop and release assembly. The stop is preferably the mound 24 in the discharge path 22 of the passage 20. The mound 24 is preferably formed to provide a steep or relatively vertical rear face 23 directed towards the reservoir 18 and a downwardly inclined forward face 25 to facilitate the trajectory development of the released ball 28. The mound 29 has sufficient height to resist the advancement of the stored balls until a ball is lifted by the release 26.

Figure 2:
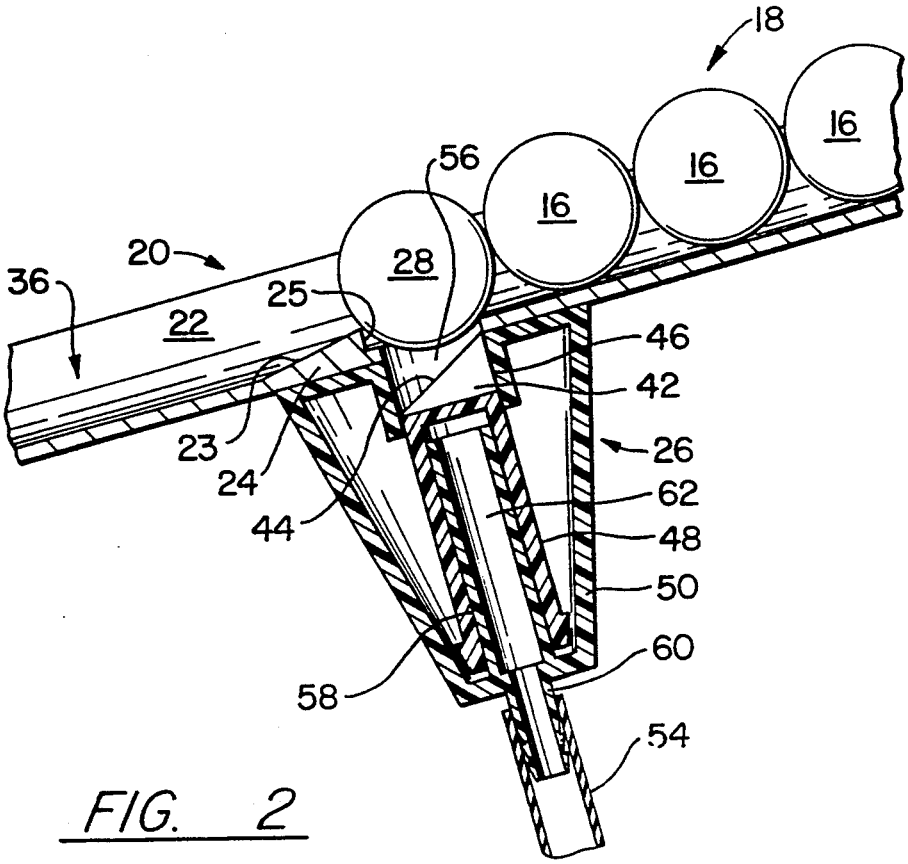
FIG. 2 is a sectional view along the length of the passage of the device, showing the stop and release assembly in a retracted position.
Figure 3:
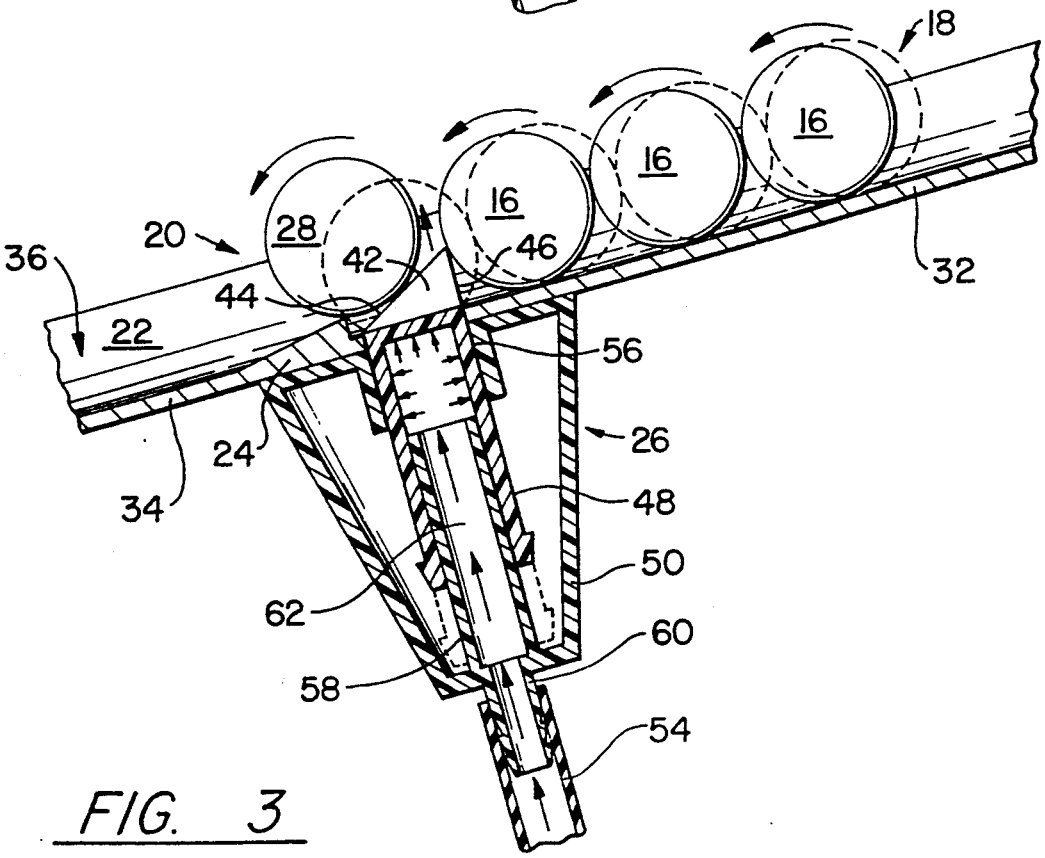
FIG. 3 is a sectional view along the length of the passage of the device, showing the stop and release assembly in an advancing position.
Figure 4:
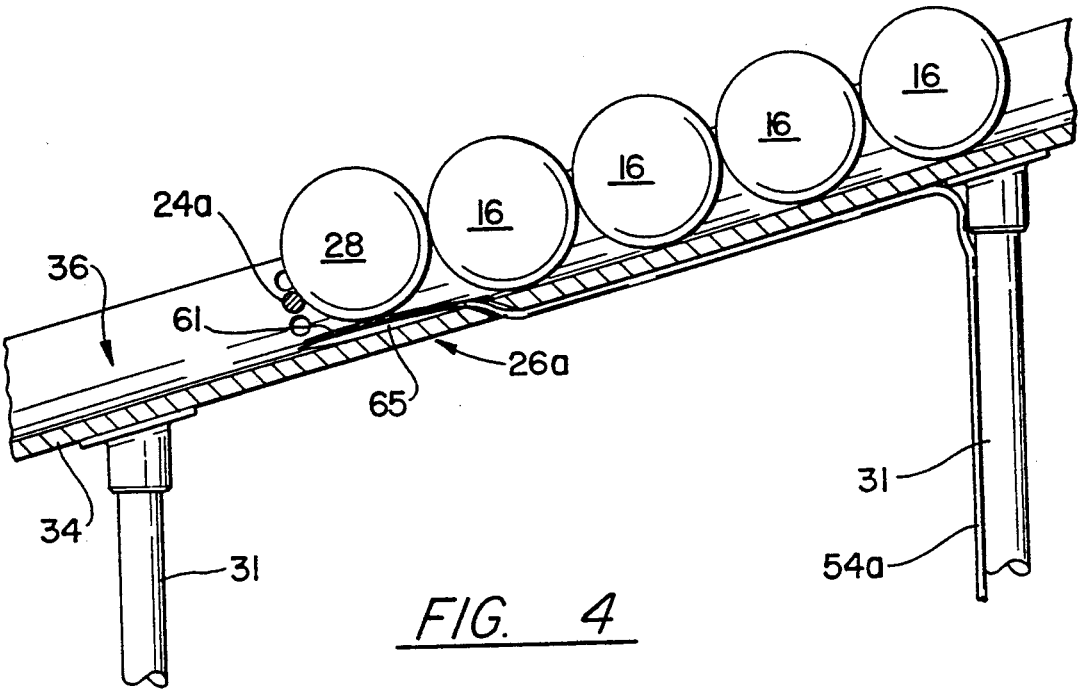
FIG. 4 is a sectional view of a second embodiment of the invention along the length of the passage, showing an air bladder stop and release assembly in an uninflated position.
Figure 5:
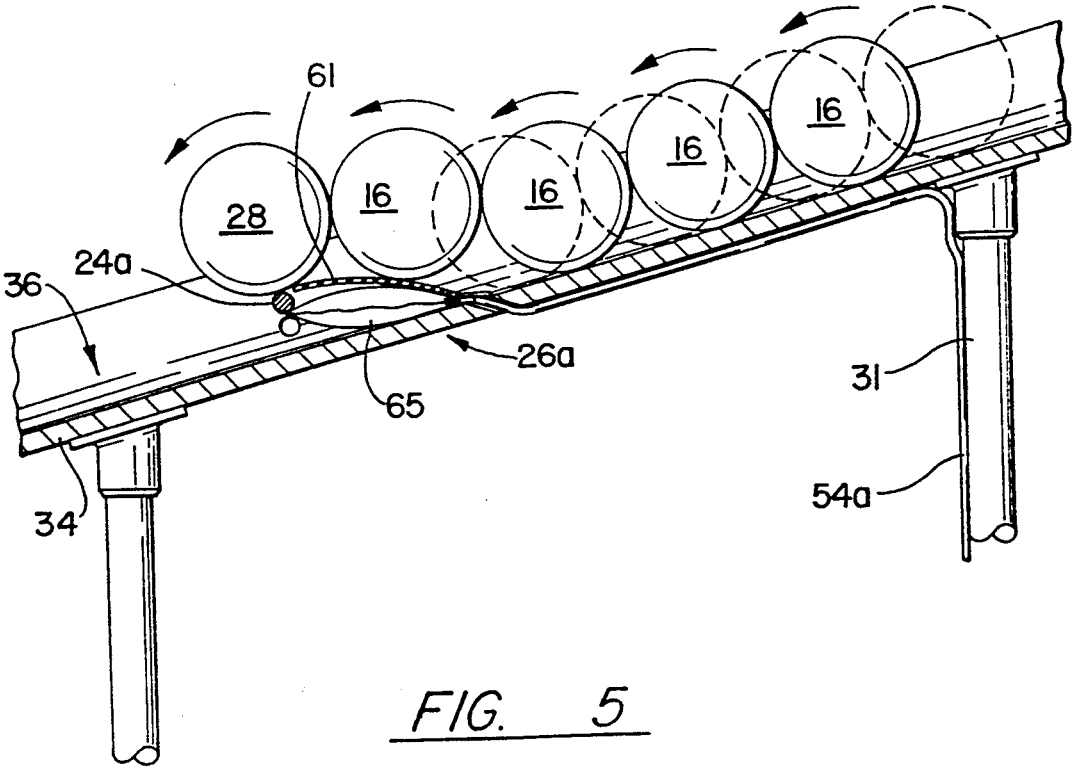
FIG. 5 is a sectional view of the second embodiment of the device, along the length of the passage of the device, showing the air bladder stop and release assembly in an inflated position.
Figure 6:
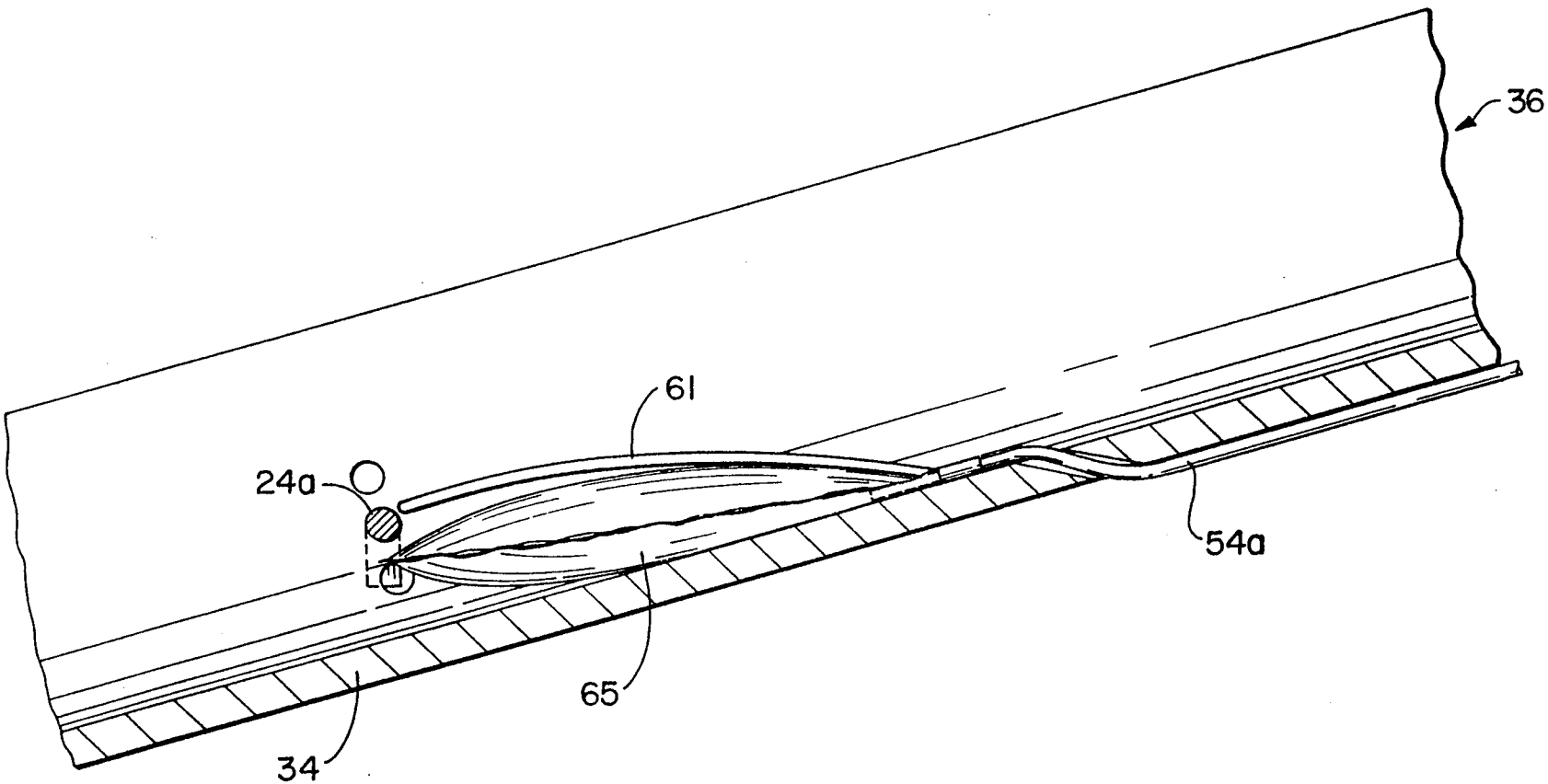
FIG. 6 is an enlarged view of the second embodiment of the device, along the length of the passage, showing the stop and release assembly in an inflated position.

Referring to FIGS. 2 and 3, the release 26 preferably includes a wedge 42. The wedge 42 preferably includes a downwardly inclined front face 44 for simultaneously lifting and forwardly urging the first ball 28 along the discharge path 22 when actuated. The rear face 46 of the wedge 42 can be transverse to the discharge path to prohibit the advancement of additional balls during the advancement of the first ball 28. The wedge 42 is movable substantially transversely to the discharge path 22 and is positioned to insert between the first ball 28 and the next ball for urging the first ball 28 past the stop 24 when actuated. The wedge 42 is preferably mounted from below the channel 34, but alternatively, can be positioned along the sides of the channel 39 and laterally advance and retract.

The wedge 42 can be actuated in a variety of ways. Preferably, the wedge 42 is driven in and out of the discharge path 22 by a piston member 48, reciprocally disposed in an air cylinder 50. The piston 48 and wedge 42 are driven out of the air cylinder 50 into the discharge path 22 by air pressure generated by the control 30, which is preferably a foot-air- ballast 52 connected to the air cylinder 50 by an air line 54 (see FIG. 1). The air ballast 52 enables the batter 12 to obtain and maintain a standard batter's stance while actuating the release 26. Alternatively, the release 26 can be actuated by a hand-held air actuator held by the attending bystander 14.

Referring particularly to FIG. 2, prior to actuation, the wedge 42 is retracted below the channel 34 between the first ball 28 and the adjacent ball in the queue. An aperture 56 is provided in the bore of the channel 34 to permit movement of the wedge 42 and piston 48 in and out of the passage 20. The balls 16 are temporarily restrained by the mound 24 on the inclined discharge path 22, and the first ball 28 can nestle in the aperture 56.

The air cylinder 50 can be secured to the bore of the channel 34 by known fasteners, and may be removably mounted to allow disassembly for compact storage. The air cylinder 50 provides a bore for receiving the piston 48, which is formed as a collar slidingly mounted on an air supply tube 58. The air supply tube 58 is connected in open communication with a hose interface 60 for receiving the actuator air line 54. Air pressure provided by the air actuator pressurizes the chamber 62 defined by the air supply tube 58 and the piston collar 48 to urge the piston 48 and wedge 42 out of the air cylinder 50 and into the passage 20.

Referring to FIG. 3, when the release 24 is actuated, the wedge 42 engages the first ball 28 in the queue. The front face 44 of the wedge 42 is angled relative to the discharge path so as to raise and advance the first ball 28 over the stop mound 24. The rear face 46 of the wedge resists the potential advancement of the next ball in the queue until the wedge 42 is retracted.

After the release of the first ball 28, the piston 48 and the wedge 42 return to their retracted position, either under their own weight or with the assistance of biasing means, such as a spring. The air cylinder 50 can also include an air release valve for discharging the pressurized air from the channel 62 after full extension of the piston 48, thereby permitting return to the retracted position.

FIGS. 4 through 7 disclose an alternative embodiment of the device of the present invention. The release 26*a* preferably includes an inflatable air bladder 65 and a flexible pad 61. Air bladder 65 may be made from any suitable material including, but not limited to, rubber, foil, mylar or plastic. Air bladder 65 can be inflated by air pressure generated by a control, which is preferably a foot air ballast, connected to the air bladder 65 by an air line 54*a*. Flexible pad 61 is mounted on top of the air bladder 65 and secured to channel 34. Air bladder 65 and flexible pad 61 are secured along one edge by clamp means 63. Clamp means 63 may comprise screws, clips, snap-lock mechanisms or any other suitable structure for securing an edge of air bladder 65 and flexible pad 61 to channel 34. The secured edge is preferably aligned transverse to the direction of ball movement in the channel 34.

Cross member 24*a* is provided for preventing balls 28, 16 from advancing until such time as may be desired by a user. When the user wishes to release ball 28, air bladder 65 is inflated beneath flexible pad 61, causing ball 28 to be forced over cross member 24*a* and proceed down runway 36.

The flexible pad 61 is preferably formed from material which is sufficiently flexible to allow it to bend along its edge secured to channel 34. Significantly, however, flexible pad 61 must also be of sufficient stiffness, so that upon inflation of the air bladder 65, the flexible pad 61 will evenly support ball 28 to urge it over cross member 24*a*. In a preferred embodiment, flexible pad 61 may be formed from a sheet of rubber between 0.07 and 0.11 inches thick. However, any suitable material of appropriate thickness may be used for this purpose.

Figure 7:
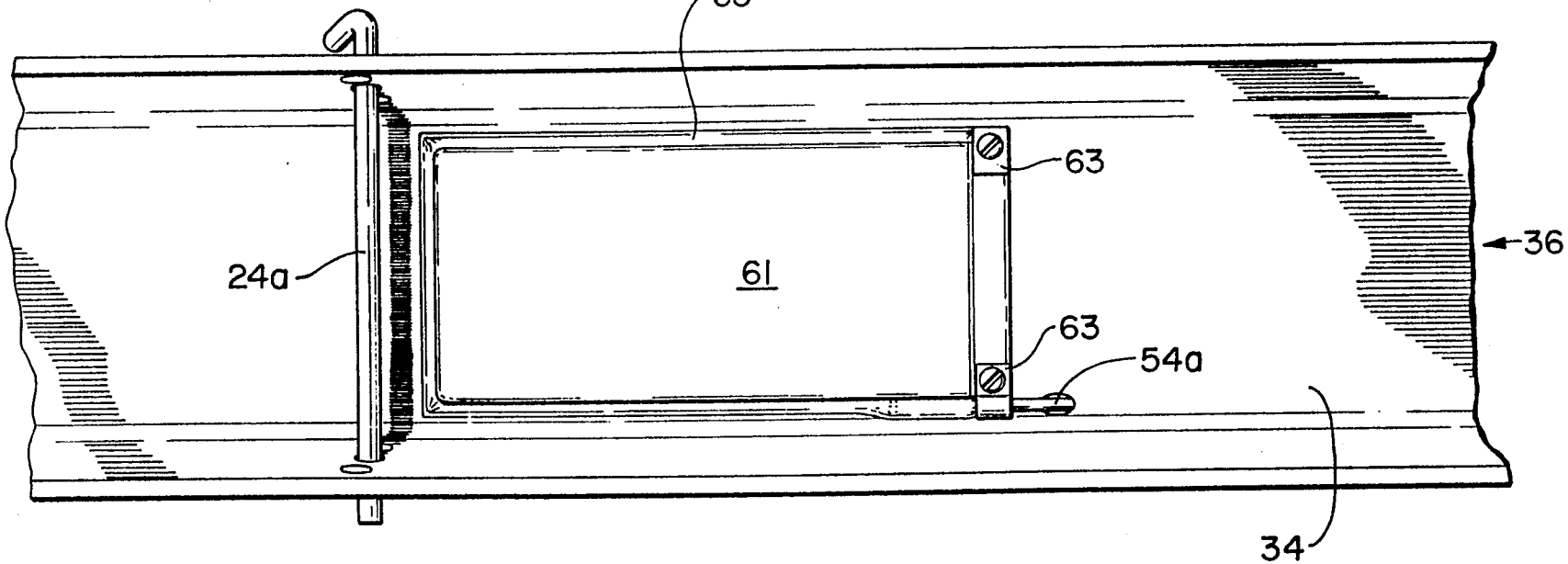
FIG. 7 is an enlarged top view of the second embodiment of the device showing the stop and release mechanism.

Referring now to FIG. 7, air line 54*a* passes through an opening in the channel 34 and is inserted, in a substantially gas-tight manner, into an air inlet in air bladder 65. Clamp means 63 may be used to maintain air line 54*a* in its position in air bladder 65.

Cross member 24*a* may be an L-shaped pin inserted through openings formed in the sides of channel 34. However, any other suitable structure capable of preventing ball advancement may be used. If an L-shaped pin is used, additional openings may be provided in the sides of channel 34 to allow the pin to be adjustably raised or lowered for use with different size balls.

While particular details of the structure and function of the invention have been set forth in the preceding description, it is expected that other alternative components which provide the described function within the scope of the invention will now be apparent to those skilled in the art. For instance, the components of the device can be made of light-weight plastics for ease of manufacture and for portability. The components can be capable of disassembly for storage in a convenient carrying case The channel can be constructed with grooves of varying widths to centrally align balls of different sizes for actuation by the stop and release assembly. Also, the channel can be enhanced for improved aesthetic appearance by application of a hood extension above the stop and release assembly portion of the passage. In view of these recited examples and other alternatives, the scope of the invention should not be determined by the specification, but rather by a reasonable interpretation of the following claims.

I claim:

1. A ball delivering device for batting and racket swinging practice of a user, said device comprising:

structure for storing a plurality of balls, said structure defining a downwardly inclined passage for gravitational transfer of balls along said passage to a user;

means for elevating said structure;

stop means in said passage for restraining movement of balls long said passage;

ball release means connected to said structure and in said passage for selectively lifting a first one of said plurality of balls over said top means for subsequent travel along said passage for delivery to a user, said release means comprising an air bladder mounted beneath a flexible pad, said air bladder and said flexible pad being positioned beneath the first ball positioned adjacent to said stop means, such that when said air bladder is inflated, a ball in said first position will be urged over said stop and down said structure passage; and means for providing a sufficient amount of air to said air bladder for intermittent inflation thereof.

2. The ball delivering device of claim 1, wherein the stop means comprises a pin which may be adjustably mounted at varying heights in said passage to stop different size balls.

3. The ball delivering device of claim 1, wherein said flexible pad is formed from a sheet of rubber between 0.07 and 0.11 inches thick.

4. The ball delivering device of claim 1, wherein said means for providing a sufficient amount of air to said air bladder for intermittent inflation thereof is an air bellows and an air line for delivering air from the bellows to the air bladder.

5. The ball delivering device of claim 1, wherein the air bladder is attached to said structure along an edge of said air bladder, said edge being aligned transverse to the direction of ball movement in said passage.

6. The ball delivering device of claim 1, wherein said air bladder is formed from a foil material.

7. The ball delivering device of claim 1, wherein the air bladder is formed from a flexible plastic material.

8. The ball delivering device of claim 1, wherein the downwardly inclined passage defined by said structure extends at least 12 inches below the stop means to permit ball trajectory development prior to release.

9. The ball delivering device of claim 1, wherein the means for elevating said structure includes an adjustable stand.

10. The ball delivering device of claim 2, wherein the adjustable height pin may be adjusted to varying heights by means of a series of openings formed in sidewalls of said structure.

11. The ball delivering device of claim 4, wherein said air bellows is foot actuated.

12. The ball delivering device of claim 4, wherein said air bellows is hand actuated.

* * * * *